US005724010A

United States Patent [19]

Brown

[11] Patent Number: 5,724,010

[45] Date of Patent: Mar. 3, 1998

[54] WIDEBAND "Y" JUNCTION ISOLATOR/ CIRCULATOR AT V-BAND

[75] Inventor: Richard N. Brown, Los Angeles, Calif.

[73] Assignee: Hughes Electronics, Los Angeles, Calif.

[21] Appl. No.: 709,972

[22] Filed: Sep. 9, 1996

[51] Int. Cl.[6] ..... H01P 1/39

[52] U.S. Cl. ..... 333/1.1; 333/24.2

[58] Field of Search ..... 333/1.1, 24.1, 333/24.2

[56] References Cited

U.S. PATENT DOCUMENTS 3,341,789 9/1967 Goodman et al. ..... 333/1.1
3,534,296 10/1970 Carr ..... 333/1.1
3,662,291 5/1972 Cotter ..... 333/1.1
5,450,045 9/1995 Miura et al. ..... 333/1.1

FOREIGN PATENT DOCUMENTS

WO 8806807 9/1988 WIPO ..... 333/1.1

*Primary Examiner*—Paul Gensler
*Attorney, Agent, or Firm*—Terje Gudmestad; Wanda K. Denson-Low; Elizabeth E. Leitereg

[57] ABSTRACT

An improved broad band "Y" junction isolator/circulator at V-Band is disclosed. A "star"-shaped ferrite structure is positioned in the isolator housing. The ferrite structure comprises two triangular-shaped ferrite members positioned 180° from each other and bonded together.

10 Claims, 2 Drawing Sheets

WIDEBAND "Y" JUNCTION ISOLATOR/ CIRCULATOR AT V-BAND

GOVERNMENT RIGHTS STATEMENT

This invention was made with Government support under contract awarded by the Government. The Government has certain rights in this invention.

TECHNICAL FIELD

The present invention relates to "Y" junction isolators/ circulators for communication systems.

BACKGROUND ART

Isolators/circulators are in common use today, particularly in satellite or spacecrafts used as components for communication systems. Typical V-Band "Y" junction isolator/ circulator members have 20 dB isolation bandwidths of about 8% to 17% (2 GHz–4 GHz).

Some satellite communication systems require increased bandwidths in order to perform their intended and specified functions. In this regard, many V-Band programs require broad bandwidths where wider frequency spreads or higher data rates are desired.

It is an object of the present invention to provide a wideband "Y" junction isolator/circulator with increased bandwidths.

It is another object of the present invention to provide a system for securing higher data rates in a satellite to aid in communications.

It is still a further object of the present invention to provide an isolator/circulator mechanism which has improved assembly and tuning time.

SUMMARY OF THE INVENTION

The above and other objects are met by the present invention which is discussed in more detail below, illustrated in the accompanying drawings, and defined by the appended claims.

In accordance with the present invention, a broad band "Y" junction isolator/circulator mechanism is provided with about a 20% to 25% (5 GHz–6.5 GHz) bandwidth at the 20 dB isolation point in the V-Band frequency range. The mechanism contains two ferrite triangles secured together forming a "star"-shaped structure. The ferrite structure is installed in a reduced-height ramped housing of the type typically used in spacecrafts and satellites.

The present invention has an increased bandwidth over known isolator/circulator mechanisms with standard ferrite structures. This provides higher data rates for communication.

Also, the time to assemble and tune the isolator/circulator mechanism in accordance with the present invention is reduced significantly from known isolator/circulator mechanisms. This results in a significant savings in manpower, time and effort.

These and other features, benefits and advantages of the present invention will become apparent from the following description when viewed in accordance with the accompanying drawings and appended claims.

BEST MODES FOR CARRYING OUT THE INVENTION

Figure 1:
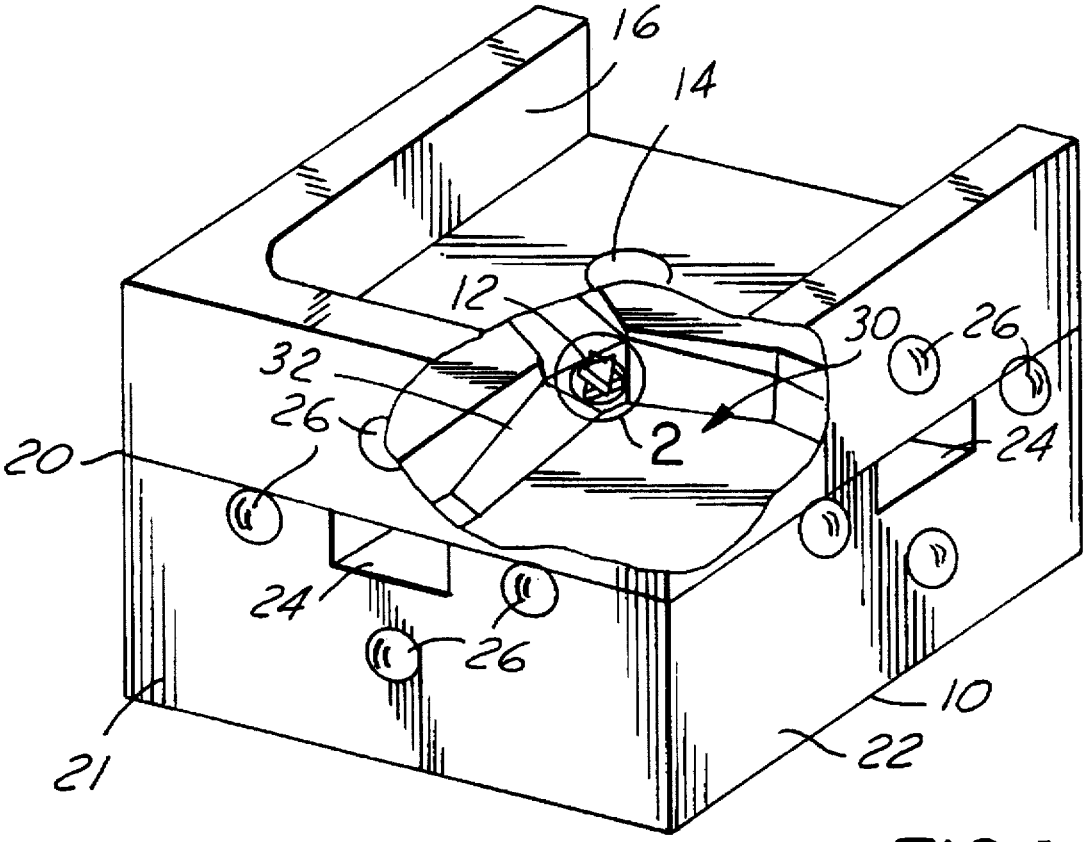
FIG. 1 illustrates a typical isolator/circulator mechanism for use with the present invention.
Figure 2:
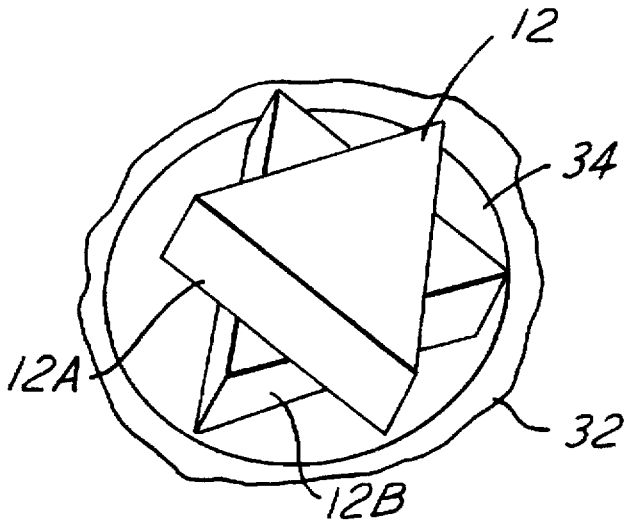
FIG. 2 illustrates the unique ferrite structure used with the present invention.

FIGS. 1 and 2 illustrate the present invention and its use as an isolator/circulator mechanism or assembly. In FIG. 1, a reduced-height ramp housing is referred to generally by the numeral 10. The housing 10 has a ferrite arrangement or structure 12 which is shown in more detail in FIG. 2.

The isolator housing 10 also has a permanent magnet 14 positioned in a recess 16 in the upper portion of the housing. On three sides 20, 21 and 22 of the housing, openings 24 are provided for insertion of a wave guide mechanism (not shown). Each of the sides 20, 21 and 22 also have a plurality of mounting holes 26 for attaching the wave guide thereto.

The internal cavity 30 of the housing 10 has a ramp section 32 on which the ferrite structure 12 is positioned. The ferrite arrangement or structure 12 is bonded to the ramp section with any conventional adhesive material, such as an epoxy material.

The preferred form of the ferrite structure in accordance with the present invention is shown in FIG. 2. The structure 12 consists of two triangular-shaped structures made of a ferrite material bonded together in a "star"-shape. The two ferrite triangles 12A and 12B are bonded together with an epoxy or equivalent material. In addition, the ferrite "star"-shaped structure is bonded to an iron core 34 which is mounted in the ramp section 32 of the isolator housing 10.

On a conventional spaceship or satellite, more than 100 and typically 200 isolator/circulator mechanisms or assemblies are provided. Each mechanism has a housing which is approximately cubular in shape, having a dimension of approximately one inch along each side. The ferrite structure 12 positioned in the housing is approximately 0.055 inches in width.

Typical V-Band "Y" junction isolator/circulator mechanisms have 20 dB isolation bandwidths of about 8% to 17% (2 GHz–4 GHz). In contrast, the star-shaped ferrite structure 12 in accordance with the present invention yields bandwidths up to 28% (7 GHz) and more typically with about a 20% to 25% (5 GHz–6.5 GHz) bandwidth. In this regard, the insertion loss in accordance with the present invention is less than 0.5 dB at 28% (7 GHz).

Presently known isolator/circulator mechanisms typically use a ferrite structure having a cylindrical configuration. These structures typically give isolation bandwidths of 1 GHz to 4 GHz at the 20 dB points. The present invention allows higher data rates for satellite communications in which increased bandwidths are desired. The present invention may be used for all V-Band programs that require broad bandwidths, both current and future, where wider frequency spreads or higher data rates are desired.

The present invention also requires less time and effort in order to tune it. At broad bandwidths, the assembly and tuning time is at least the same as and probably slightly improved with the ferrite structure in accordance with the present invention. The assembling and tuning time is significantly reduced, however, if less bandwidth is desired. In this regard, at lower bandwidths, the tuning time can be as little as 25% of the tuning time for known isolator/circulator mechanisms. This results in a significant amount of savings in labor time and effort.

Figure 3:
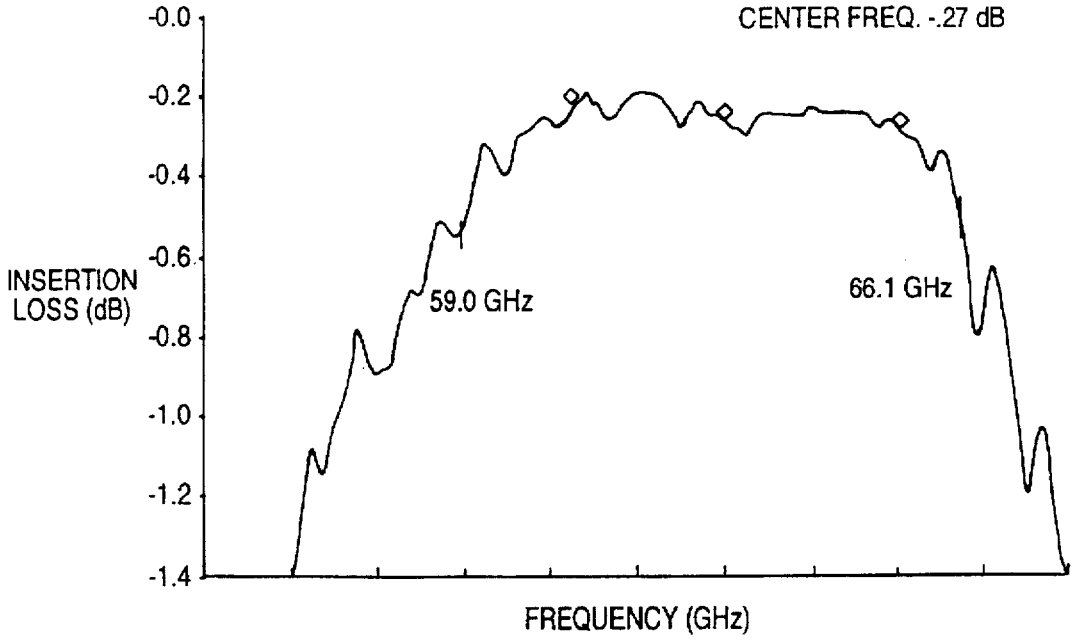
FIG. 3 is a graph depicting insertion loss data in accordance with use of the present invention.

FIG. 3 is a graph depicting the insertion loss data with use of an isolator/circulator in accordance with the present invention. The center frequency insertion loss is minus 0.27 dB.

Figure 4:
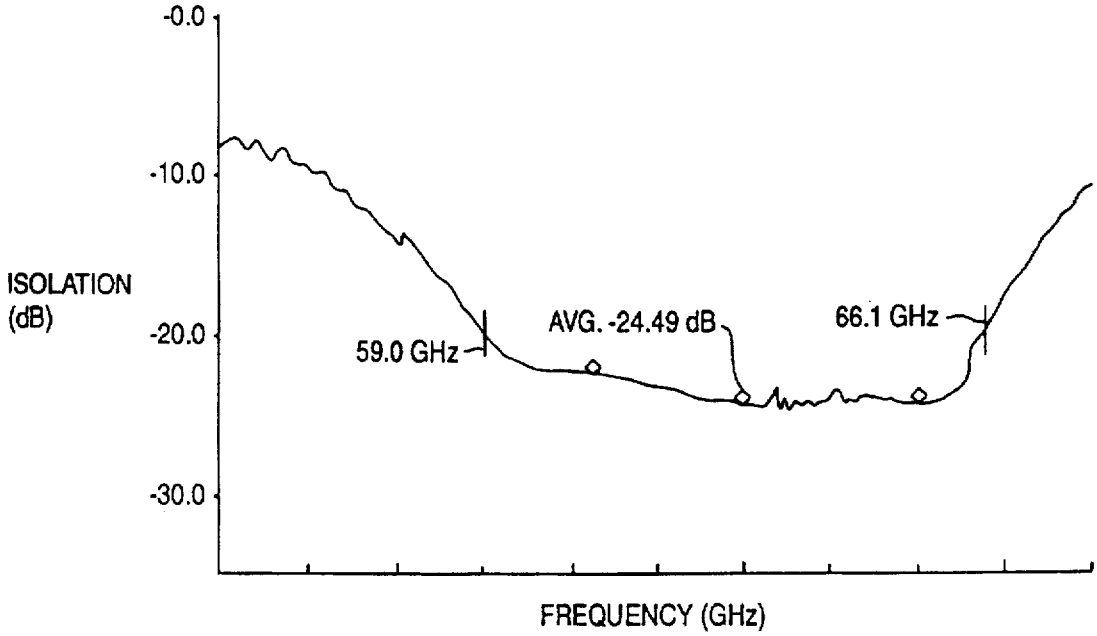
FIG. 4 is a graph illustrating the isolation data curve for an isolator/circulator mechanism in accordance with the present invention.

FIG. 4 is a graph illustrating the isolation data curve for an isolator/circulator in which the present inventive ferrite structure is utilized. In this regard, the average isolation is minus 24.49 dB.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A wideband "Y" junction isolator/circulator at V-Band comprising:

a housing arranged to be connected to a plurality of waveguide mechanisms;

a ramp section forming a waveguide within said housing; and a six-point "star"-shaped ferrite structure positioned on a junction point of said ramp section.

2. The apparatus of claim 1 wherein said ferrite structure comprises a pair of triangular members secured together so that the points of one of the triangular members are offset relative to the points on the other triangular member by 180° in order to form the "star" shape.

3. The apparatus of claim 1 wherein said ferrite structure comprises at least two triangular members secured together.

4. An isolator comprising:

a housing having a plurality of waveguide paths extending therein; and at least one six-point "star"-shaped ferrite structure positioned in said housing at a junction point for said plurality of waveguide paths.

5. The isolator of claim wherein said ferrite [member] structure comprises at least two ferrite members secured together to form the six-point star shape.

6. The isolator of claim 4 wherein said housing has a recess with a permanent magnet positioned therein, the plurality of waveguide paths including a ramp section therein.

7. The isolator of claim 6 wherein said ferrite structure is secured to said ramp section.

8. The isolator of claim 7 further comprising an iron core member in said ramp section and wherein said ferrite structure is secured to said iron core member.

9. A process for making an improved isolator device for a satellite, said process comprising the steps of:

providing at least two triangular-shaped ferrite members;

securing said two ferrite members together to form a six-point "star"-shaped ferrite structure; and securing said ferrite structure to said isolator device.

10. The isolator of claim 9 wherein said triangular-shaped ferrite members are positioned so that the points of the respective triangular members are offset relative to each other by 180° to form said ferrite structure.

* * * * *